United States Patent [19]

Falcone et al.

[11] Patent Number: 4,989,739

[45] Date of Patent: Feb. 5, 1991

[54] SAFETY CAP FOR CONTAINERS

[76] Inventors: Domenic A. Falcone; Ida F. Falcone, both of 14423 Chadbourne, Houston, Tex. 77079

[21] Appl. No.: 529,667

[22] Filed: May 29, 1990

[51] Int. Cl.[5] ..... B65D 55/10

[52] U.S. Cl. ..... 215/221

[58] Field of Search ..... 215/221, 203, 207, 220, 215/305

[56] References Cited

U.S. PATENT DOCUMENTS

| | | | |
|---|---|---|---|
| 3,376,992 | 4/1968 | Klapp, Sr. | 215/221 X |
| 3,526,332 | 9/1970 | Adelberger | 215/207 |
| 4,154,353 | 5/1979 | Hoo . | |
| 4,371,088 | 2/1983 | Gach | 215/220 |
| 4,512,484 | 4/1985 | Mar | 215/221 |
| 4,690,292 | 9/1987 | Henning . | |
| 4,756,434 | 7/1988 | Frank . | |

*Primary Examiner*—Stephen P. Garbe
*Assistant Examiner*—Vanessa M. Roberts

[57] ABSTRACT

A child-resistant safety cap that can be screwed on or off a container. A lock pin is slidably positioned to extend through a hole in the cap side wall into an opening in a radial flange carried on the neck area of the container, such that the lock pin acts as an obstruction into the cap rotation. Finger pressure can be applied to a partially-concealed end area of the lock pin to move the pin to a position where it can be manually pulled to a position separated from the container flange; the cap then be unscrewed from the container.

6 Claims, 1 Drawing Sheet

SAFETY CAP FOR CONTAINERS

BACKGROUND AND SUMMARY OF THE INVENTION

This invention relates to a safety cap for containers containing substances that might pose a danger if consumed by children or persons not having the ability to understand the danger. Such safety caps are sometimes termed "child resistant" caps or "childproof" caps.

A particular object of this invention is to provide a safety cap that has the desired "child resistant" feature, but is nevertheless openable with a relatively small manual effort. The invention accomplishes the "child resistant" feature by concealing the cap actuator from direct view, not by making the actuator difficult to operate.

Some existing safety caps use actuators that include beads or lugs designed to snap over lips or flanges on the container mouth in order to remove the cap from the container. Safety is achieved because the child is physically unable to apply enough force on the actuator to pry the cap off of the container. A problem with such arrangements is that many older persons, especially persons afflicted with arthritis, do not have the manual dexterity to operate the caps.

The present invention contemplates a screw-on cap structure equipped with an add-on locking pin that extends axially into an opening in an annular flange formed on the container. In its normal position the pin acts as an anti-rotation device to prevent the cap from being manually unscrewed from the container. The pin has an accessible free end located underneath the container flange in a partially concealed position. The person can exert finger pressure on the accessible free end of the pin to move the pin to a position partially projecting above the cap; a pulling motion on the projecting portion of the pin moves the pin to a position wherein it does not obstruct turning motion of the cap off of the container.

The locking pin is designed to be partially concealed from view, such that it is not likely to be noticed by a small child. Also, the pin is adapted to be moved with only a relatively small manual force, thereby making it usable by older arthritic persons who may not have a great deal of hand strength or manual dexterity. Additionally, the pin is constructed so that two distinct motions are required to move the pin from its obstruct position to its non-obstruct position, i.e. a push-up motion with the person's finger, and a pulling motion after the outer end of the pin has been projected from the cap surface. This last-mentioned feature makes the cap structure child resistant.

THE DRAWINGS

DESCRIPTION OF A PREFERRED EMBODIMENT OF THE INVENTION

Figure 1:
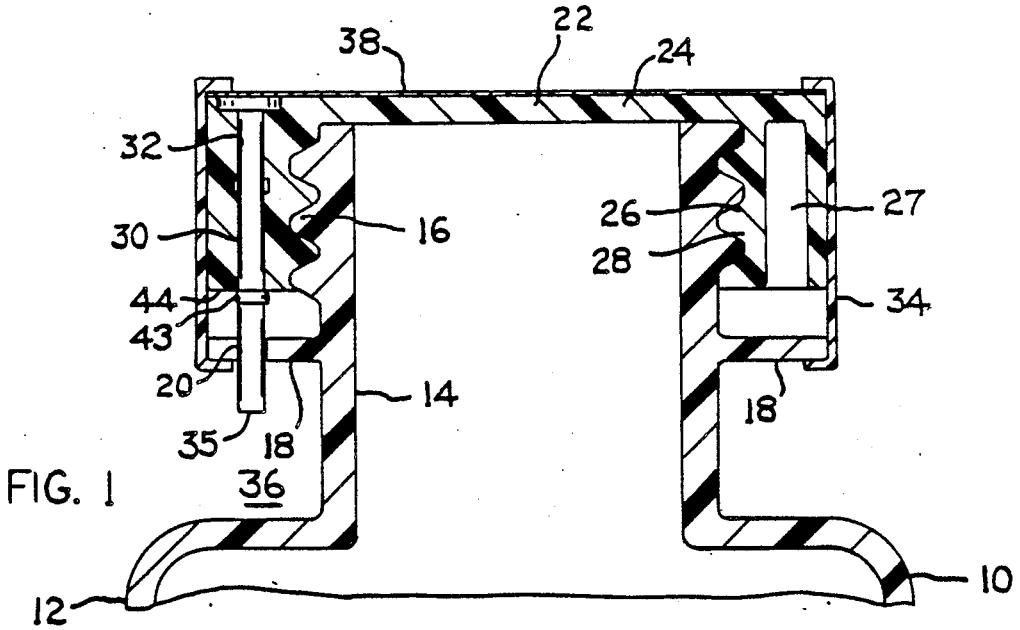
FIG. 1 is a sectional view through a container-cap assembly embodying the invention.

The drawing fragmentarily show a container 10 of a type that might be used to contain potentially harmful substances, i.e. substances that are either poisonous or that could be harmful to a child if taken in large quantities. Such substances could be prescription drugs or over-the-counter drugs in pill form or liquid form, or any container containing poisonous substances.

The container comprises a bottle structure formed of a plastic material. It includes a main container portion that defines a bottle side wall 12. The upper end of the plastic bottle includes a cylindrical wall 14 that forms a mouth for the bottle. External threads 16 extend along and around wall 14. Below the threaded area there is formed an annular radial flange 18. An opening 20 extends through the flange.

The bottle is adapted to be closed (sealed) by a removable cap structure 22, that includes a radial end wall 24 and a circumferential wall 26. A groove 27 may extend partially around wall 26 to economize on material. Internal threads 28 are formed on wall 26 to mesh with the external threads 16 on container wall 14, such that the cap structure can be screwed onto the container to assume the closed condition shown in FIGS. 1 and 2.

Our invention is concerned primarily with a lock pin 30 that is slidably positioned within an opening 32 extending through a radially thickened section of circumferential wall 26. The lock pin may be formed of metal (e.g. steel) or rigid plastic material. As shown in FIG. 1, pin 30 extends downwardly beyond opening 32 and through the opening 20 in container flange 18. The pin thus serves as an anti-rotation device to prevent cap structure 22 from being turned (unscrewed) relative to the container.

In preferred practice of the invention a seal (covering) is provided around (over) cap structure 22 to assure the customer that the container has not been opened (or otherwise tampered with) after leaving the factory (packaging point). The seal can include a thin aluminium foil membrane (sheet) 38 adhesively secured to end face 25 of cap structure 22, and an annular sleeve 34 having a shrink fit on the cap structure and flange 18. Sleeve 34 would usually be a thin plastic sleeve that is shrunk onto (around) the cap structure by a heat-shrink process.

Figure 2:
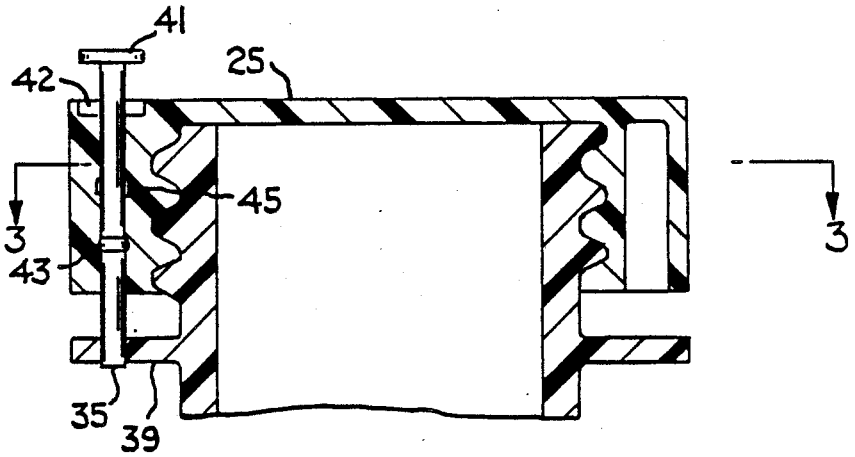
FIG. 2 is a view taken in the same direction as FIG. 1, but showing the component parts in a different condition of adjustment.

The customer would be expected to break sleeve 34 away from cap structure 22 and to peel off foil membrane 38, prior to using the bottle to dispense the bottle contents. FIG. 2 shows the anti-tamper assurance components removed from the bottle.

The space 36 below flange 18 is made accessible for upward displacement of locking pin 30 by finger pressure on the lower end 35 of the pin. FIG. 1 shows pin 30 in its lowered position. FIG. 2 shows the pin after it has been pushed up to a point where its lower end 35 is substantially flush with the lower face of flange 18. When pin 30 is in its FIG. 2 position the upper end portion of the pin is elevated above the end face 25 of the cap structure, such that the person can then grasp the upper end of the pin to pull the pin upwardly from the FIG. 2 position to the FIG. 4 position. In the FIG. 4 position of the pin, the pin is in a "non-obstruct" position completely separated from container flange 18. Cap structure 22 can therefore be unscrewed from the container to gain access to the container contents.

Figure 4:
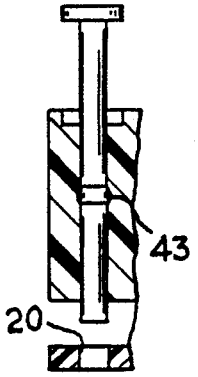
FIG. 4 is a fragmentary sectional view taken in the same direction as FIG. 2, but illustrating one of the components in a different position of adjustment.

In order to facilitate manual pull up of the pin to the FIG. 4 position the upper end of the pin is enlarged, as at 41. In the unopened condition of the cap structure the pin enlargement seats within a recess 42 in cap end face 25, such that the end face of the pin enlargement is flush with the cap end face. This makes it substantially impossible for a child to pull up the pin to the FIG. 4 position, except by first using finger pressure on the other end 35 of the pin.

Pin 30 preferably has a friction fit in opening (hole) 32, such that the pin will be frictionally retained in any position to which it has been moved, i.e. pin 30 will not fall out of opening 32 if a child should overturn the container. Additionally, the pin can have an intermediate annular section 43 thereof bulged outwardly to a slight extent. When pin 30 is in its FIG. 1 "obstruct" position annular section 43 is located just below the end surface 44 of cap wall 26. The bulging section of the pin acts as a detent to keep the pin in position.

An annular groove 45 is formed at an intermediate point along the length of hole 32. When pin 30 is pulled upwardly to the FIG. 4 position the bulged portion 43 of the pin snaps into the groove 45 to hold the pin in place while the cap structure is being screwed on or off of the container. The cap structure will be formed of a plastic material having some resilience. Detent portion 43 of the pin can move through hole 32 with only a moderate application of force to the pin; The detent portion 43 is only a few thousandths of an inch larger than the pin diameter, such that the hole 32 surface can deform enough to permit passage of the detent portion. Detent portion 43 can be considered as a localized high-friction area of the pin.

Figure 3:
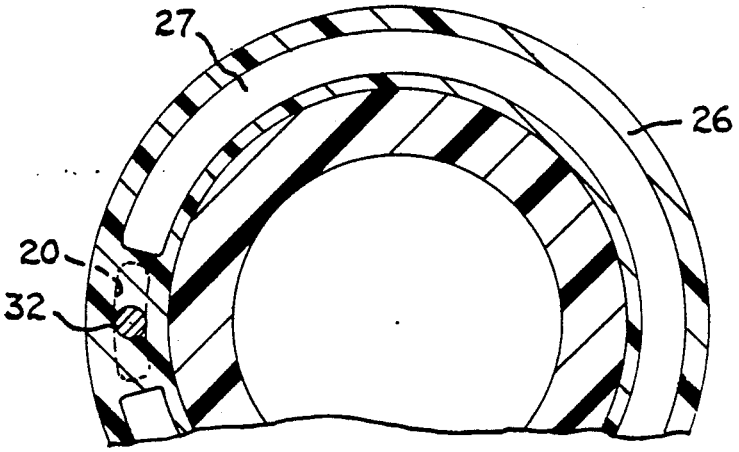
FIG. 3 is a sectional view taken on line 3—3 in FIG. 2.

Openings 32 and 20 are orientated so that when the cap structure 22 is fully screwed onto the container the two openings will be axially aligned, as shown in FIGS. 1 and 2. However, in order to compensate for variations in tightness (between a loose fit and a tight fit) opening 20 is formed as a circumferential opening (FIG. 3). The opening can extend circumferentially around the central axis of cylindrical wall 14 for thirty or more degrees.

Whether cap structure 22 is screwed down tightly or loosely some portion of opening 20 will align with opening (hole) 32.

The relationship between locking pin 30 and container flange 18 constitutes a principal feature of our invention. A child resistant operational mode is achieved, due to the fact that cap structure can only be opened by a specific sequence of three separate motions (operations). First the person must apply finger pressure to end 35 of pin 30 to push the pin from the FIG. 1 position to the FIG. 2 position. Then the person must exert a pulling force on pin enlargement 41 to move the pin to the FIG. 4 non-obstruct position. Finally, the cap structure must be unscrewed from the container. It is believed that a child would find it difficult to go through the specific sequence of events necessary to open the container. End 35 of the pin is in a semi-concealed position underneath cap 22.

The illustrated arrangement is advantageous in that no great hand strength is required to open the container. Pin 30 can be readily pushed and then pulled to achieve the FIG. 4 non-obstruct position. The unscrewing operation is achieved without a great deal of effort. Older persons afflicted with arthritis should have the hand strength and manual dexterity to open the cap structure when necessary.

If the user should desire not to have the safety feature then pin 30 can be removed from opening 32, in which event cap structure 22 can be used as a standard screw cap (with no locking function).

We claim:

1. In combination, a container having a cylindrical wall forming a mouth; external threads extending along and around said mouth wall; a flange radiating from said mouth wall, said flange having a first face proximate to the external threads and a second face remote from the threads; a first opening extending through said flange;

a cap that includes a radial end wall having an outer end face, and a circumferential wall extending axially from the radial end wall away from said outer end face; internal threads on said circumferential wall adapted to mesh with the external threads for screw-on attachment of the cap to the container;

a second opening extending from the cap outer end face through the circumferential wall;

said first and second opening being orientated so that when the cap is fully screwed onto the container the two openings are axially aligned;

and a lock pin slidably positioned in said second opening; said pin having a length that is greater than the distance from the cap end face to the second face of the container flange when the cap is fully screwed onto the container; said pin having a cap rotation-obstruct position extending through both openings, and a non-obstruct position removed from the first opening;

the space adjacent to the second face of the flange being accessible for actuation of the locking pin by finger pressure on an end of said pin.

2. The combination of claim 1, and further comprising an enlargement on one end of said pin for manual pull out of the pin from the second opening.

3. The combination of claim 2, wherein said enlargement has a flat end, and a recess in the outer end face of the cap end wall for accommodating said pin enlargement so that the end face of the enlargement normally lies flush with the cap end face.

4. The combination of claim 3, and further comprising a destructible membrane extending along and across the cap end face, such that the membrane must first be destroyed in order to push the pin from its rotation-obstruct position toward its non-obstruct position.

5. The combination of claim 1, wherein said first opening extends circumferentially for a measurable distance around the axis of the cylindrical mouth wall, whereby the two openings will be aligned even though the cap has a relatively loose or a relatively tight fit when it is nominally screwed onto the container.

6. The combination of claim 1, wherein said pin has a frictional fit in said second opening, whereby a measurable axial force must be applied to the pin to move it from its obstruct position or its non-obstruct position.

* * * * *